US010594044B1

(12) United States Patent
Taenzer

(10) Patent No.: US 10,594,044 B1
(45) Date of Patent: Mar. 17, 2020

(54) WIDE-DIRECTION ANTENNA

(71) Applicant: Jon C. Taenzer, Los Altos, CA (US)

(72) Inventor: Jon C. Taenzer, Los Altos, CA (US)

( * ) Notice: Subject to any disclaimer, the term of this patent is extended or adjusted under 35 U.S.C. 154(b) by 0 days.

(21) Appl. No.: 16/295,451

(22) Filed: Mar. 7, 2019

(51) Int. Cl.

| | |
|---|---|
| ***H01Q 19/10*** | (2006.01) |
| ***H01Q 21/06*** | (2006.01) |
| ***H01Q 1/52*** | (2006.01) |
| ***H01Q 19/13*** | (2006.01) |
| *H01Q 21/20* | (2006.01) |

(52) U.S. Cl.
CPC ..... *H01Q 21/062* (2013.01); *H01Q 1/52* (2013.01); *H01Q 19/106* (2013.01); *H01Q 19/13* (2013.01); *H01Q 21/205* (2013.01)

(58) Field of Classification Search
CPC ..... H01Q 21/062; H01Q 1/52; H01Q 19/106; H01Q 19/13; H01Q 21/205
See application file for complete search history.

(56) References Cited

U.S. PATENT DOCUMENTS

| | | | |
|---|---|---|---|
| 1,747,008 | A | 2/1930 | Moses |
| 2,175,253 | A | 10/1939 | Carter |
| 2,207,781 | A | 7/1940 | Brown |
| 2,267,889 | A | 12/1941 | Roger |
| 2,270,314 | A | 1/1942 | Kraus |
| 2,338,564 | A | 1/1944 | Aram |
| 2,615,005 | A | 10/1952 | White |
| 2,665,380 | A | 1/1954 | Hickson et al. |
| 2,666,138 | A | 1/1954 | Ehrbar et al. |
| D171,560 | S | 2/1954 | Rutter |
| D174,992 | S | 6/1955 | Kumpis |
| D175,733 | S | 10/1955 | Kumpis |
| 2,918,672 | A | 12/1959 | Hoverman |
| RE25,604 | E | 6/1964 | Greenberg |
| 3,148,371 | A | 9/1964 | Hoverman |
| D202,709 | S | 11/1965 | Larson |
| 3,228,031 | A | 1/1966 | Nobuo et al. |
| D209,147 | S | 11/1967 | Johnson |
| 3,369,245 | A | 2/1968 | Rea |
| 3,373,432 | A | 3/1968 | Breneman |
| 3,531,805 | A | 9/1970 | Winegard et al. |

(Continued)

OTHER PUBLICATIONS

"DIY TV Antennas",https://m4antenna.eastmasonvilleweather.com/index.html, N.D. 3 Pages.

(Continued)

*Primary Examiner* — Dameon E Levi
*Assistant Examiner* — David E Lotter
(74) *Attorney, Agent, or Firm* — Shami Messinger PLLC

(57) ABSTRACT

In one embodiment, an antenna for receiving incident electromagnetic (EM) radiation includes a dipole having first and second elements, and a reflector for reflecting the incident EM radiation into reflected EM radiation. The reflector, first element, and second element are configured to orient the first element substantially broadside to the reflected EM radiation and end-fire to the incident EM radiation when the second element is oriented substantially broadside to the incident EM radiation. Conversely, they are configured to orient the second element substantially broadside to the reflected EM radiation and end-fire to the incident EM radiation when the first element is oriented substantially broadside to the incident EM radiation.

12 Claims, 12 Drawing Sheets

(56) References Cited

U.S. PATENT DOCUMENTS

| | | | | |
|---|---|---|---|---|
| 3,665,478 | A | 5/1972 | Dempsey | |
| 3,984,841 | A | 10/1976 | Mikulich et al. | |
| 4,062,019 | A * | 12/1977 | Woodward | H01Q 21/205 343/797 |
| 4,095,230 | A | 6/1978 | Salmond et al. | |
| 4,149,169 | A | 4/1979 | Weber | |
| 4,160,980 | A | 7/1979 | Murray | |
| 4,209,790 | A | 6/1980 | Newcomb | |
| 4,219,821 | A | 8/1980 | Selim | |
| 4,293,861 | A | 10/1981 | Winegard et al. | |
| 4,308,540 | A | 12/1981 | Winegard et al. | |
| 4,584,586 | A | 4/1986 | Kocsi | |
| D293,786 | S | 1/1988 | Redaelli | |
| D293,787 | S | 1/1988 | Redaelli | |
| 4,766,441 | A | 8/1988 | Phillips et al. | |
| D305,766 | S | 1/1990 | Tai | |
| 5,696,372 | A | 12/1997 | Grober et al. | |
| 5,774,094 | A | 6/1998 | Yonezaki | |
| 5,969,687 | A | 10/1999 | Podger | |
| 5,986,609 | A | 11/1999 | Spall | |
| 6,054,963 | A | 4/2000 | Muterspaugh | |
| 6,057,805 | A | 5/2000 | Harrington | |
| 6,078,298 | A | 6/2000 | Planning et al. | |
| 6,154,182 | A | 11/2000 | McLean | |
| 6,271,800 | B1 | 8/2001 | Nakamura et al. | |
| 6,323,821 | B1 | 11/2001 | McLean | |
| 6,342,862 | B1 | 1/2002 | Schoenthal | |
| 6,466,178 | B1 | 10/2002 | Muterspaugh | |
| 6,480,168 | B1 | 11/2002 | Lam et al. | |
| 6,762,730 | B2 | 7/2004 | Schadler | |
| 6,839,038 | B2 | 1/2005 | Weinstein | |
| D501,466 | S | 2/2005 | Charlot, Jr. | |
| 6,922,179 | B2 | 7/2005 | McCollum | |
| D516,063 | S | 2/2006 | Lai et al. | |
| 7,050,013 | B2 | 5/2006 | Kim et al. | |
| 7,091,841 | B2 | 8/2006 | Adamson et al. | |
| 7,113,147 | B2 | 9/2006 | McCollum | |
| 7,142,166 | B2 | 11/2006 | Martek | |
| D547,754 | S | 7/2007 | Oliver | |
| 7,265,718 | B2 | 9/2007 | Tsai | |
| D598,433 | S | 8/2009 | Schneider et al. | |
| 7,609,213 | B2 | 10/2009 | Wong et al. | |
| 7,609,222 | B2 | 10/2009 | Schneider et al. | |
| 7,990,332 | B1 | 8/2011 | Tischer | |
| 8,081,132 | B2 | 12/2011 | Su | |
| 8,144,069 | B2 | 3/2012 | Sadowski et al. | |
| 8,368,607 | B2 | 2/2013 | Schneider et al. | |
| 8,648,770 | B2 | 2/2014 | Schneider et al. | |
| 8,674,897 | B2 | 3/2014 | Schneider et al. | |
| 8,773,322 | B2 | 7/2014 | Wong et al. | |
| 8,994,600 | B2 | 3/2015 | Schneider et al. | |
| 9,024,839 | B2 | 5/2015 | Schneider et al. | |
| 9,059,507 | B2 | 6/2015 | Schneider et al. | |
| 9,281,566 | B2 | 3/2016 | Apostolos et al. | |
| 2010/0302118 | A1 | 12/2010 | Suleiman et al. | |
| 2011/0187629 | A1 * | 8/2011 | Nam | H01L 51/5243 345/76 |

OTHER PUBLICATIONS

"Ev's Recommended & Top Rated DTV Indoor UHF_VHF Set Top Antenna Review Round-Up Guide—AVS Forum_Home Theater Discussions and Reviews", https://www.avsforum.com/forum/25-hdtv-technical/1037779-ev-s-recommended-top-rated-dtv-indoor-uhf-vhf-set-top-antenna-review-round-up-guide.html, N.D., 94 Pages.

"Field Tested Antennas", https://m4antenna.eastmasonvilleweather.com/index.html, N.D. 3 Pages.

"I built this Antenna today CM4228 clone almost", https://www.dtvusaforum.com/threads/i-built-this-antenna-today-cm4228-clone-almost.24028/page-2, N.D. 14 Pages.

"Repligation_ Building an HDTV Antenna db2, db4", http://repligation.blogspot.com/2012/06/building-hdtv-antenna-db2-db4.html, N.D. 20 Pages.

"Television Frequency Table", http-//www.csgnetwork.com/tvfreqtable.html.pdf, N.D., 13 pages.

Muse, Dave, "Make This Powerful HDTV Antenna Out of Cardboard", https://hubpages.com/art/make-this-powerful-hdtv-antenna-out-of-cardboard, Nov. 10, 2015. 3 Pages.

Silver, Ward H. (editor), "Cheap Antennas for the AMSAT LEO's Kent Britain—WA5VJB", 2014 ARRL Handbook for Radio Communications, Supplement, 2014. 7 pages.

Silver, Ward H. (editor), "Dual-Band Antenna for 146/446 MHz", 2014 ARRL Handbook for Radio Communications, Supplement, 2014. 1 page.

Silver, Ward H. (editor), "Rotatable Dipole Inverted-U Antenna", 2014 ARRL Handbook for Radio Communications, Supplement, 2014. 5 pages.

Silver, Ward H. (editor), "Vertical Loop Antenna for 28 MHz", 2014 ARRL Handbook for Radio Communications, Supplement, 2014. 1 page.

* cited by examiner

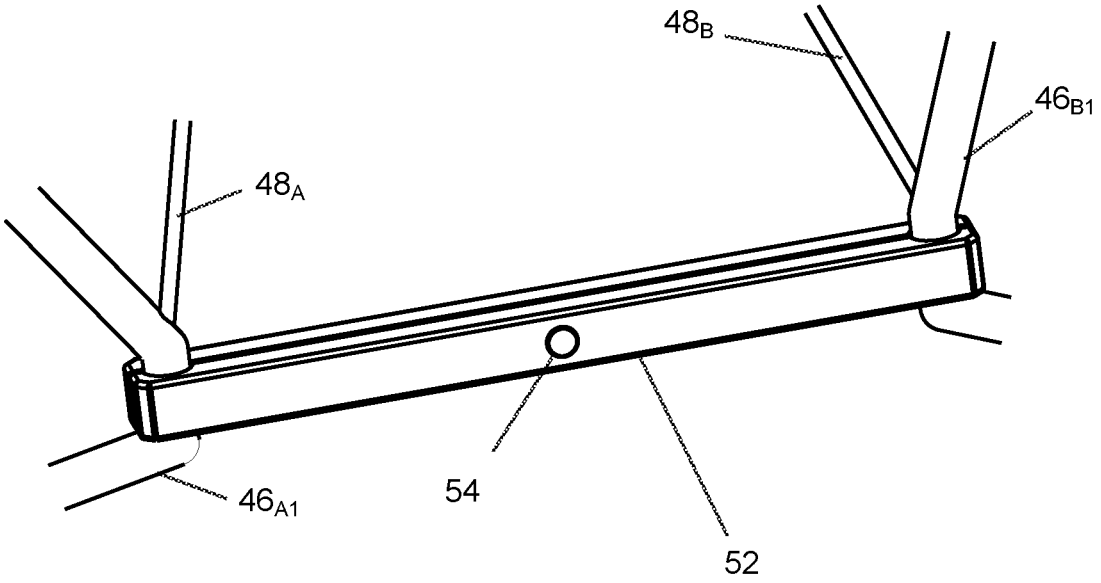
*FIG. 11*
*FIG. 14*
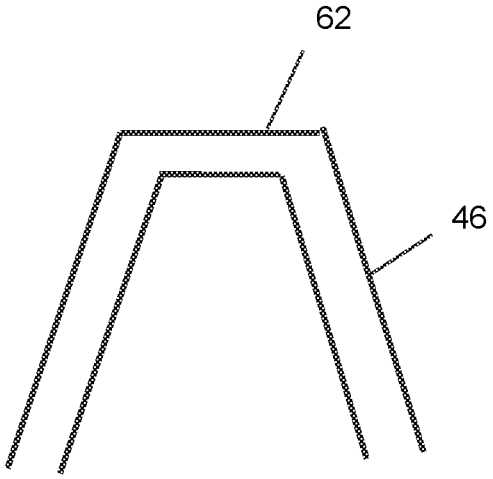

470 MHz
590 MHz
710 MHz

WIDE-DIRECTION ANTENNA

TECHNICAL FIELD

The present disclosure generally relates to antenna assemblies such as those configured for reception of television signals, including high definition television (HDTV) signals.

BACKGROUND

Many people enjoy watching television, and the television-watching experience has been greatly improved due to HDTV. Although a great number of people pay for HDTV through their existing cable or satellite TV service provider, in fact, HDTV signals are required to be broadcast over the free public airwaves. This means that HDTV signals may be received for free with the appropriate antenna.

Modern homes often have several TV sets located in multiple rooms, for example, in living rooms, bedrooms and family rooms, where different individuals may be simultaneously watching dissimilar TV program channels. Such homes have TV signal distribution wiring which typically carries signals from a single antenna location and distributes them to each set location.

However, often the signals for different channel frequencies arrive at the antenna from different transmitter directions. Available antennas are usually optimized for highest signal sensitivity, meaning that they have relatively narrow acceptance angles, so pointing the antenna for best reception of one channel might not be optimum for receiving another channel. This creates a problem when the same antenna is to be used for receiving more than one channel at a time.

In the past, the direction problem has been addressed by using a) a motorized antenna rotator to aim the antenna toward the broadcast being watched, b) an array of antennas, each aimed toward different arriving signals, or c) an omni-directional antenna. The first solution does not solve the multiple-viewer issue and adds cost and inconvenience; the second solution requires that the antennas in the array be at least one wavelength apart at the lowest frequency and have electrical isolation, i.e. separate amplifiers or filters associated with each antenna in the array, the result of which is both bulky and expensive; and the third solution is mainly applicable in close proximity to the TV transmitters because omni-directional antennas generally have low signal sensitivity and no directions from which the antenna can reject interfering signals.

Various antennas and/or antenna/reflector combinations, such as wideband antennas and bow-tie antennas, are disclosed in U.S. Pat. Nos. 2,918,672, 3,373,432, 4,160,980, 4,293,861, 6,466,178, 6,480,168, 7,050,013, 7,990,332, 8,674,897, 8,773,322, 8,994,600, 9,281,566.

Most HDTV digital signals are broadcast in the high UHF band from 470 to 710 MHz. Therefore, a need exists to provide a compact UHF antenna optimized to receive high definition television (HDTV) digital signals in the UHF band. A further need exists for a wide beam width antenna with high interference rejection. Yet a further need exists for a UHF antenna with good sensitivity. Another need exists for a low cost HDTV antenna for use outdoors or indoors that has an aesthetic appearance. Furthermore, a need exists for such an antenna to be easily constructed for low cost using conventional manufacturing methods and materials.

Many antennas are based upon the dipole principle. Starting with a basic dipole element, many antenna designs add passive elements, such as directors and/or reflectors, to enhance their performance in order to achieve certain performance goals. For example, the well-known Yagi-Uda antenna design employs this method to enhance the sensitivity in a desired direction, at the expense of sensitivity in other directions. In other words, the Yagi antenna has good gain, but is highly directional. The use of added passive elements is particularly true of terrestrial television (TV) antenna designs where the extra elements help to improve their signal capturing gain, but also where this method limits the ability of such antennas to simultaneously receive signals from multiple directions.

Since in North America, terrestrial TV signals are required to be horizontally polarized, i.e. the e-field lies in the horizontal plane, TV antennae must be designed to pick-up such signals. The basic horizontal dipole antenna is horizontally polarized, so it has an antenna pattern which is omni-directional in the vertical plane, but has a figure-8 shape in the azimuthal (horizontal) plane. Thus, the dipole has maximum sensitivity when the signal approaches from the broad side of the antenna, but no pick-up sensitivity when the incoming signal approaches from the ends of the antenna.

Antenna gain is specified as the ratio of sensitivity in the direction of greatest signal pick-up to that of a reference antenna, expressed in decibels (dB). The reference antenna is commonly taken as a hypothetical intrinsic antenna—one with equal sensitivity in all directions—so the gain is expressed in dBi, where the "i" indicates that the reference being used is the intrinsic antenna. In the direction of maximum sensitivity, i.e. when the incoming signal approaches broadside to the antenna, the dipole has a (maximum) gain of about 2 dBi.

In turn, the half power beamwidth (HPBW or 3 dB down BW) is approximately 70 degrees. Note that at the edges of the beam, the gain is −1 dBi which is actually less than that of the intrinsic antenna. Thus, the low gain and narrow beamwidth of the unaided dipole makes it a poor candidate for TV reception, in spite of its wide use in the common "rabbit ears" design.

One approach to improving the gain of a dipole antenna is to add a passive reflector behind the active dipole in order to redirect incoming energy, which has not been captured and has passed by the dipole, back toward the dipole. Such reflectors are highly effective. An extreme example is the parabolic dish antenna used for radio astronomy or spacecraft communications, where many tens of dBi of gain are achieved, yet still using only a dipole as the active element. However, whenever a reflector is used to improve gain, there is a sacrifice in beamwidth. The above mentioned dish antennas have extremely narrow beamwidths, which is beneficial for radio astronomy or space communications, but not necessarily for terrestrial TV reception. When adding even a simple plane reflector behind a dipole, the maximum forward gain can be increased to over 7 dBi, but the beamwidth then decreases to less than 65 degrees.

In virtually all terrestrial TV reception antenna designs, both halves of the dipole are energized by the same electromagnetic (EM) wave. Even with a reflector, where the dipole receives energy from two directions at once, there is no difference between the energy arriving at each half of the dipole. This is also true when directors are added to the design. The active dipole element "sees" the same signal energy and amplitude at each half, and in-phase, as is required for proper operation.

FIG. 1 shows the signal excitation pattern for a simplified conventional TV antenna 10 design employing a dipole active element 12*a*, 12*b* with a passive reflector 14. The thin solid lines designate the arriving EM wave with the direction of arrival shown by the solid hollow arrow 16. The dashed lines designate the reflected EM wave with the direction of reflected wave propagation shown by the dashed hollow arrow 18.

In the conventional configuration of FIG. 1, the upper and lower halves of the dipole, 10*a* and 10*b* respectively, are equally excited by both the incoming EM energy and the reflected EM energy. However, because both EM waves are arriving at the dipole from an off-axis direction, the signal sensitivity of the dipole is reduced from what would be achieved if the waves were arriving broadside to the dipole.

OVERVIEW

Described herein is a compact digital television antenna that uses a unique design to increase the width of the reception angle to produce a substantially wider beam width than conventional antennas without increasing antenna size. The antenna described herein can achieve beam widths of greater than 130 degrees, while maintaining virtually constant, and relatively high, sensitivity over the entire angular range, and excellent rejection of interfering signals arriving from the rear of the antenna and above/below the antenna. This inherent interference rejection allows for low unwanted-signal interference, and provides a clean signal to the receiving apparatus.

The antenna is configured to electrically match its load impedance for maximizing the signal transferred to the load and minimizing signal reflections within the transmission line connecting the antenna to the load (e.g. television set). The antenna described herein has a remarkably accurate impedance match to the universal impedance of 300 Ohms across its extremely wide bandwidth of operation.

In certain embodiments, the antenna consists of two swept back V-shaped dipoles arranged one above the other, and spaced slightly in front of a planar reflector. The dipoles are supported at their corners by insulating elements. A feed assembly of conductors carries the received signal to a central location where an insulating connecting "block" is conveniently located for making the output connection, either directly to 300 Ohm feed line, or via a "balun transformer" to match the impedance to a different value, for example the commonly used 75 Ohms coaxial feed line. The balun transformer may be separate, or housed within the connecting block. The front of the V-shaped elements is held separated by two insulating bars. Thus, in certain embodiments, the entire antenna consists of four main V-shaped active elements, two Y-shaped feed elements comprising the feed assembly, seven insulators of only three different shapes and the planar reflector.

The antenna described herein can be used for either or both receiving and transmitting.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments.

In the drawings:

FIG. 11 shows an insulator bar connecting the apexes of two V-shaped conductors;

FIG. 14 shows a configuration of a V-shaped conductor in accordance with certain embodiments;

DESCRIPTION OF EXAMPLE EMBODIMENTS

Example embodiments are described herein in the context of an antenna. The following description is illustrative only and is not intended to be in any way limiting. Other embodiments will readily suggest themselves to those of ordinary skill in the art having the benefit of this disclosure. Reference will be made in detail to implementations of the example embodiments as illustrated in the accompanying drawings. The same reference indicators will be used to the extent possible throughout the drawings and the following description to refer to the same or like items.

In the description of example embodiments that follows, references to "one embodiment", "an embodiment", "an example embodiment", "certain embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. The term "exemplary" when used herein means "serving as an example, instance or illustration." Any embodiment described herein as "exemplary" is not necessarily to be construed as preferred or advantageous over other embodiments.

In the interest of clarity, not all of the routine features of the implementations described herein are shown and described. It will be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

Figure 2:
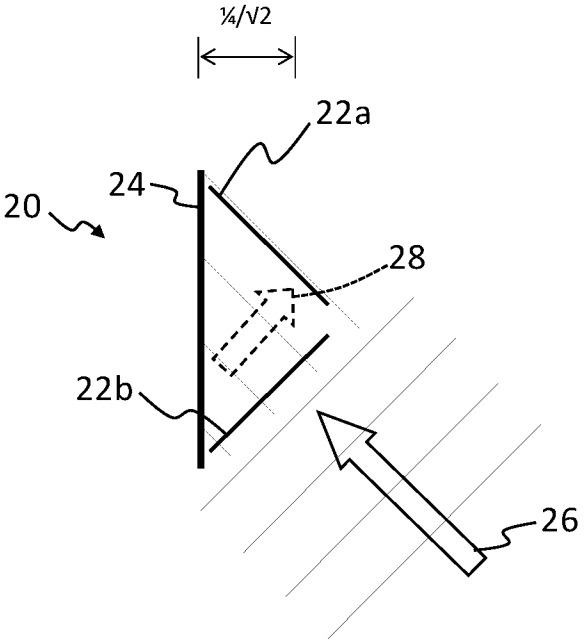
FIG. 2 shows the signal excitation pattern for a wide-direction antenna 20 in accordance with certain embodiments.

FIG. 2 shows the signal excitation pattern for a wide-direction antenna 20 in accordance with certain embodiments. The antenna 20 includes dipole active elements 22*a*, 22*b* with a passive reflector 24. The thin solid lines designate the arriving incident EM wave, with the direction of arrival shown by the solid hollow arrow 26. The dashed lines designate the reflected EM wave, with the direction of reflected wave propagation shown by the dashed hollow arrow 28.

The configuration of the wide-direction antenna 20 allows both the upper (22*a*) and lower (22*b*) halves of the dipole to be excited by energy arriving broadside to each half—the lower half being energized by the incoming EM wave and the upper half being energized by the reflected EM wave. (It should be noted that the terms "upper" and "lower" are used for convenience only and do not denote a preferred orientation of the antenna.) This is because the dipole is only sensitive to EM energy arriving broadside to the element and is insensitive to energy arriving from the ends—that is, from the end-fire direction. Thus, the wide-direction antenna 20 design is notably different from conventional antenna designs in that the individual halves of the active dipole are energized by different sources of energy. In particular, the reflector 24, the first element 22*a*, and the second element 22*b* are configured to orient the first element 22*a* substantially broadside to the reflected EM radiation and end-fire to the incident EM radiation when the second element 22*b* is oriented substantially broadside to the incident EM radiation. The converse, of course, is also true: the reflector 24, the first element 22*a*, and the second element 22*b* are configured to orient the second element 22*b* substantially broadside to the reflected EM radiation and end-fire to the incident EM radiation when the first element 22*a* is oriented substantially broadside to the incident EM radiation. Moreover, although the discussion herein relates to reception of incoming EM radiation, the same principles apply for transmission of EM signals by antenna 20, as is expected in the antenna art.

Figure 1:
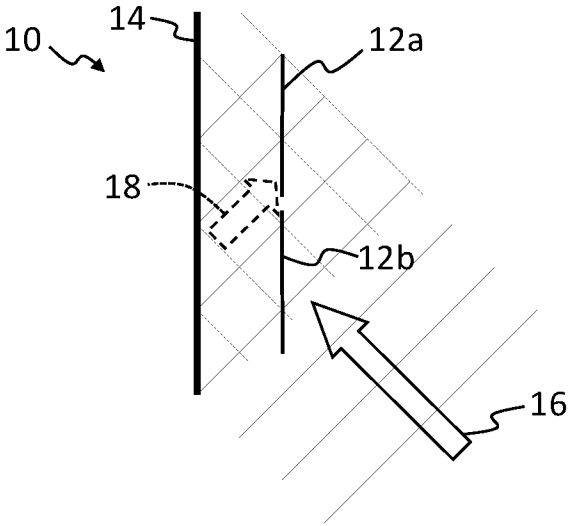
FIG. 1 (Prior Art)
FIG. 1 shows the signal excitation pattern for a simplified conventional TV antenna design employing a dipole active element 12*a*, 12*b* with a passive reflector 14.

Of course, in both the conventional design of FIG. 1 and the wide-direction antenna 20 design of FIG. 2, there are constraints on the dimensions so that the waves arrive in a manner that reinforce each other, i.e. where they are in-phase at the dipole. This is achieved when the dipole is approximately ¼-wavelength in front of the reflector with the conventional design, and on average approximately $\frac{1}{4}/\sqrt{2}$-wavelength with the wide-direction antenna 20 design. The square-root-of-two term is due to the optimization for off-axis performance. That is, as shown in FIG. 2, the spacing is also ¼-wavelength, but along the extra path length from the first half of the dipole element to the other half of the dipole. This shorter spacing helps to reduce the size of the wide-direction antenna 20 as explained below.

The wide-direction antenna 20 operates similarly to a conventional dipole antenna when the signal comes from straight ahead—that is, both halves of the dipole receive equal energy both from the direct arriving EM wave and also from the reflected EM wave. Thus, the performance of the wide-direction antenna 20 is similar to the conventional design over a range of acceptance angles close to "straight ahead". Where the wide-direction antenna 20 differs is that this performance is maintained out to much greater acceptance angles than the conventional designs. In other words, the new design has a much greater beam width. Beam widths of nearly 180 degrees can be achieved with the wide-direction antenna 20 design.

Besides having a very broad beam width, another advantage of the wide-direction antenna 20 design is that it allows for a smaller, more compact antenna. The two designs of FIGS. 1 and 2 are drawn approximately to the same scale. Thus, it is apparent that the new design shown in FIG. 2 is smaller than that of the conventional antenna as shown in FIG. 1. This reduction in size is primarily due to the wide-direction antenna 20 design having a smaller reflector. Because of the swept back design of the dipole, the reflector can be appreciably smaller in extent since it is just energizing half of the dipole. Further, because of its V-shape, the dipole itself in the wide-direction antenna 20 becomes more compact. Therefore, overall the size of this wide-direction antenna 20 is quite small, which reduces wind resistance, shipping volume and weight, and it even allows for less conspicuous indoor use.

In addition, the wide-direction antenna 20 has improved signal interference/multipath performance. Although the addition of a reflector does reduce the conventional dipole's sensitivity to interference and multipath signals arriving from the rear of the antenna, the excess omni-directional dipole's sensitivity in the vertical direction allows for the pick-up of spurious interfering and multipath signals from, for example, aircraft flying overhead and/or electronics or motors etc. located below the antenna. Since all TV transmissions originate from broadcast stations on the ground (i.e. in the horizontal plane), there is no need for the excess vertical sensitivity and instead it is a liability. The wide-direction antenna 20, by comparison, exhibits significantly reduced vertical sensitivity, as can be seen from the vertical cross-section beam patterns described infra. Because of the relatively narrow vertical beam shape, the wide-direction antenna 20 also displays significantly reduced interference pick-up, providing a much cleaner signal for better TV viewing, while still maintaining excellent sensitivity for TV signals coming from multiple azimuthal directions.

As there are many types of dipole antennas, for example, the simple and folded dipoles, the bowtie (see, for example, U.S. Pat. No. 2,175,253), biquad, biconical (see, for example, U.S. Pat. No. 2,267,889), etc., it is beneficial that the wide-direction antenna design principle described herein works with nearly all of them. Therefore, it is possible to utilize the disclosed design for broadening an antenna's beam width to enhance the performance of many conventional antenna designs. It should be noted that, due to the large element tip diameter of the prior art biconical dipole, a half-bicone should be used so the rearward canted dipole shape can be accomplished without the element ends touching, or shorting to, the reflector.

In addition, known antenna bandwidth widening methods, such as using large diameter dipole elements, and tapered, or triangular, dipole elements are all compatible with the V-shaped elements used herein and are just one example for broadbanding an antenna. All known such methods are compatible with the wide-direction antenna 20, providing further advantages of the design.

Figure 3:
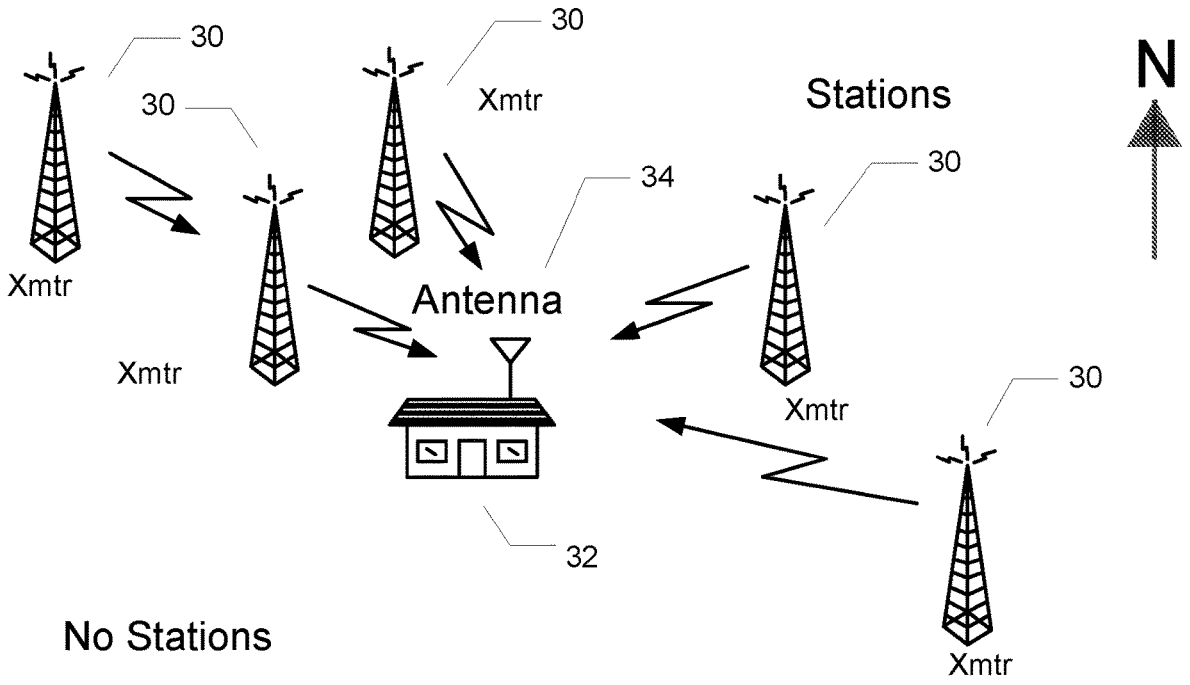
FIG. 3 (Prior Art)
FIG. 3 is a diagrammatic depiction of the reception situation encountered in numerous locations conventionally.

Turning to FIG. 3, a diagrammatic depiction of the reception situation encountered in numerous locations where there are TV stations situated such that their signals arrive at a TV viewing location from one side only, but over a wide reception angle, and no (or no desirable) signals arrive from the other side of the TV viewing location. In the example shown, broadcast stations, 30, are shown to be located to the northeast of the consumer's reception and viewing site, 32, depicted as a home with external receiving antenna, 34, while no stations are located to the southwest.

Figure 4:
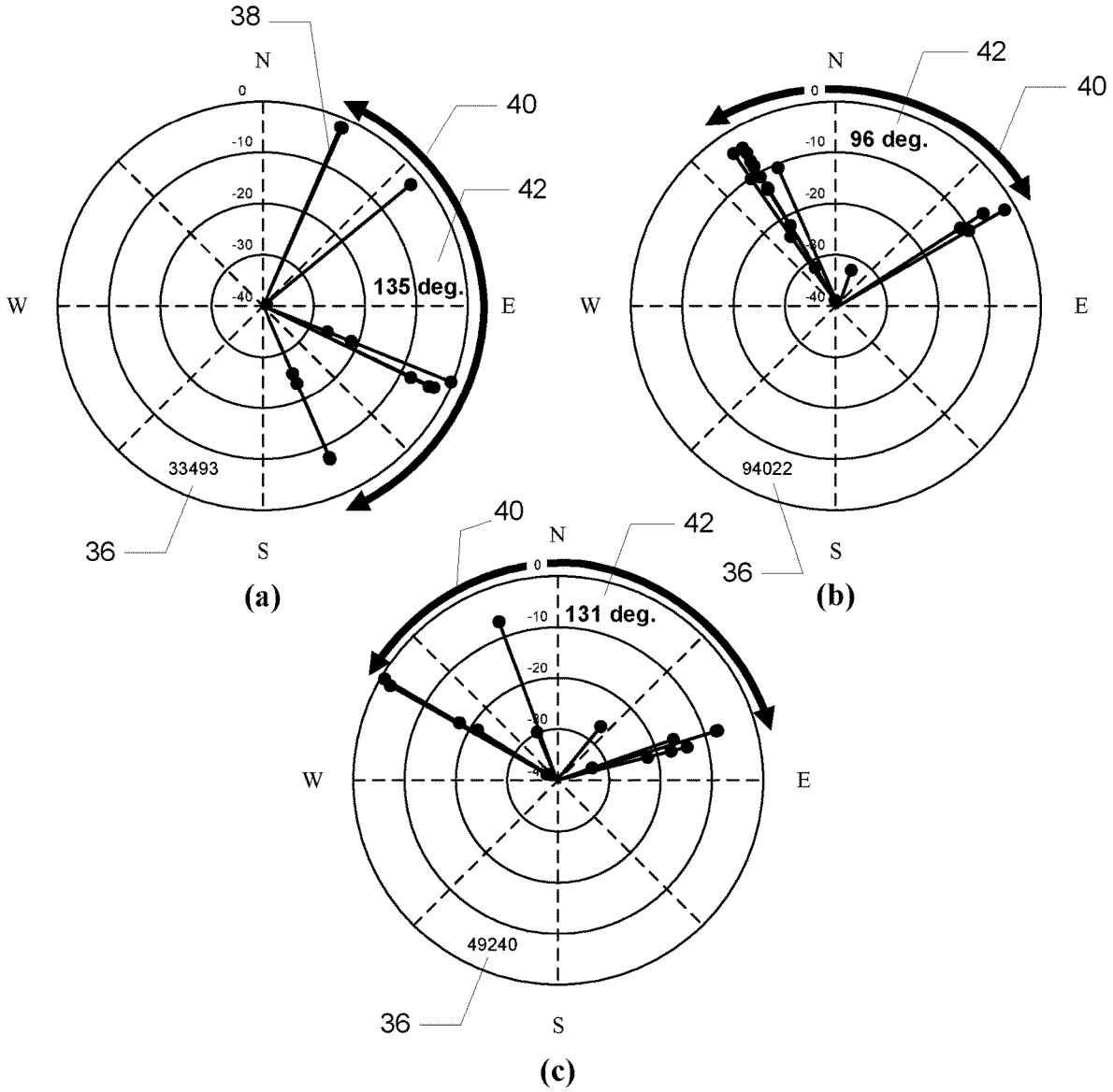
FIG. 4 (Prior Art)
FIG. 4 shows conventional TV reception radar diagrams for three different zip-code locations.

In FIG. 4, TV reception radar diagrams for three different zip-code locations, 36, in the United States are shown. In each diagram, the directions of radial lines, 38, depict the incoming compass angles at that location for TV station signals. Each radial line shows the reception angle and signal strength for each receivable TV station, where the center point of each diagram represents the location of the antenna used for receiving the station's signal. The relative signal strength for that station is depicted by the length of each radial line. In each of these cases, the signals arrive from over a significant reception angle, as shown by the arc-shaped dark double-ended arrows, 40. Each arrow is labeled with the total subtended angle, 42. In these examples, the subtended angle ranges from 96 degrees to 135 degrees. In order for the receiving antenna to simultaneously collect signals from all the broadcast stations, it must have a beam width equal to, or greater than, the subtended angle shown.

Figure 5:
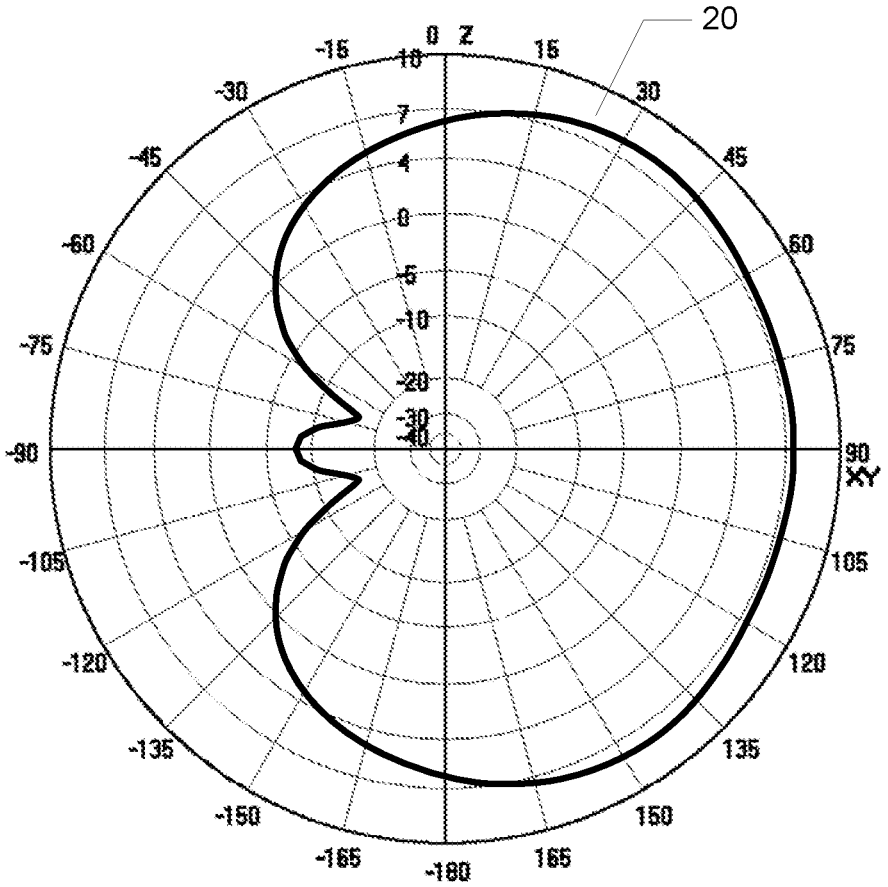
FIG. 5 graphically shows the beam pattern of the antenna of certain embodiments herein.

FIG. 5 graphically shows the beam pattern, 20, of the antenna of certain embodiments, such as wide-direction antenna 20, at 590 MHz. The antenna is well-suited to achieve good reception over the entire broad range of incoming reception angles shown in FIG. 4. Further, the sensitivity of the antenna is substantially uniform over the entire beam width, yet has a very good gain of over 7 dBi. Yet further, any interfering signals arriving from the rear of the antenna are well eliminated by the very low sensitivity in the rearward direction.

Figure 6:
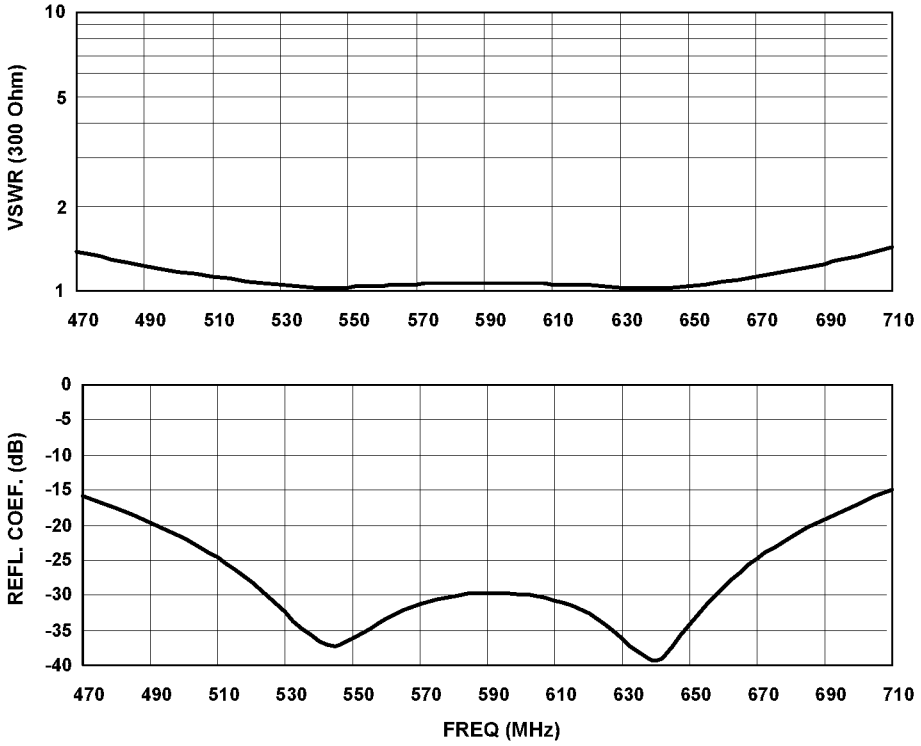
FIG. 6 shows the Voltage Standing Wave Ratio (VSWR) and corresponding Reflection Coefficient of the antenna of certain embodiments herein.

FIG. 6 shows the Voltage Standing Wave Ratio (VSWR) and corresponding Reflection Coefficient of the antenna of certain embodiments, such as wide-direction antenna 20, across all reception frequencies. These measures depict the quality of the impedance match of the antenna's impedance to that of the intended load impedance, in this case 300 Ohms. It is desirable to have a good match in order to minimize standing waves in the transmission line (down lead) connecting the antenna to the viewer's TV apparatus, thus suppressing artifacts, break-up and "ghosting" in the TV picture. A VSWR of less than 2 dB (Refl. Coef. of <−10 dB) is considered excellent performance, and it can be seen that the antenna exceeds these criteria.

Figure 7:
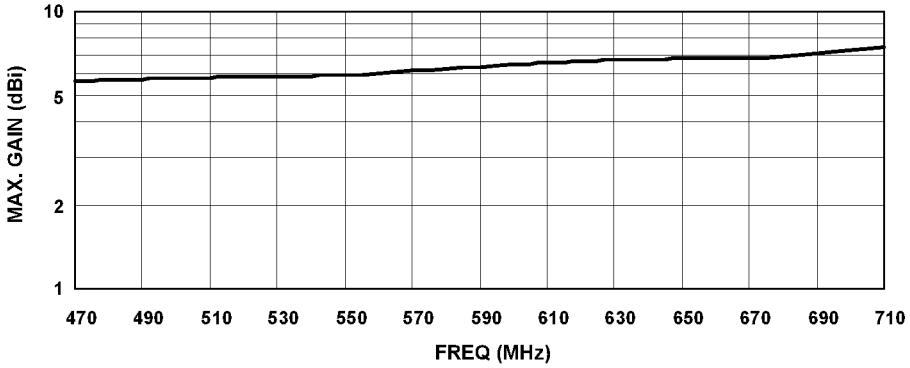
FIG. 7 is a plot of the gain of an antenna in accordance with certain embodiments.

In addition, with reference to FIG. 7, it can be seen that the antenna's gain is reasonably high and uniform, and thereby achieves quality performance. FIG. 7 shows, in dBi, the measured antenna gain over the entire frequency range of operation. Antenna gain is the ratio of antenna sensitivity to that of an intrinsic antenna, which is a hypothetical antenna which has exactly the same sensitivity for signals arriving from any direction. As can be seen, the gain of the antenna of certain embodiments herein, such as wide-direction antenna 20, is high and uniform over frequency.

Figure 8:
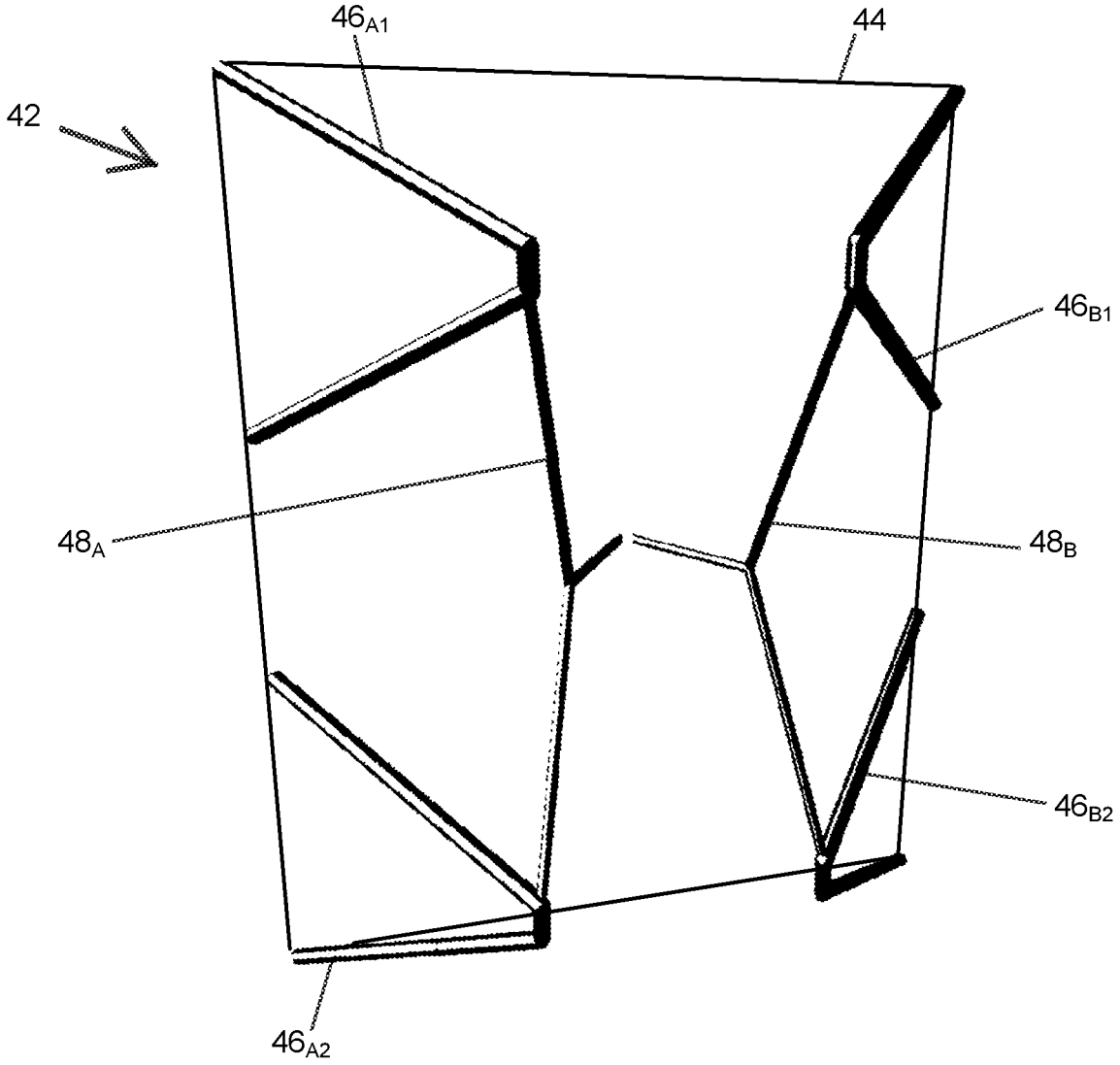
FIGS. 8 and 9 are front views of a wide-direction antenna 42 in accordance with certain embodiments.
Figure 9:
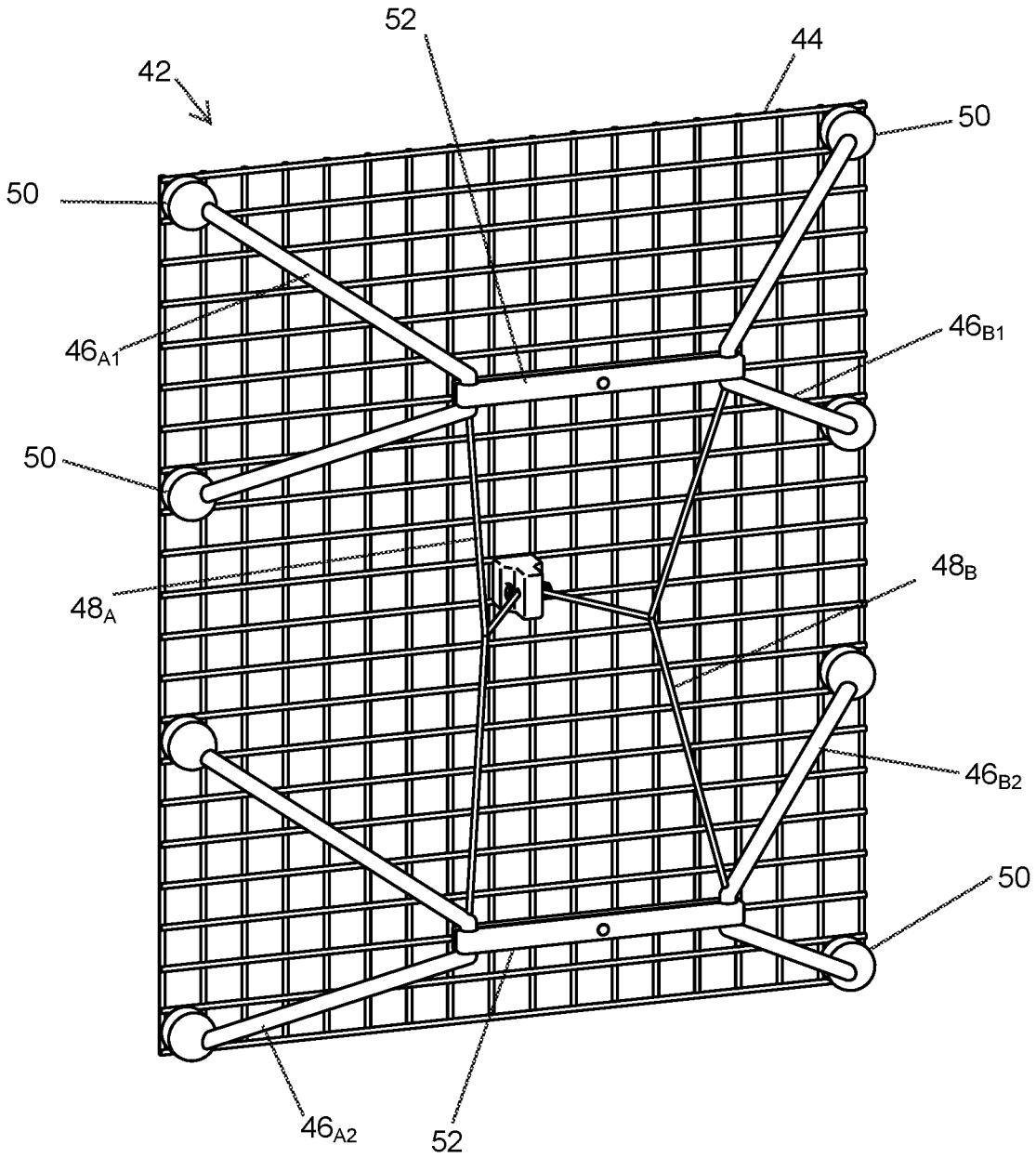

FIGS. 8 and 9 are front views of a wide-direction antenna 42 in accordance with certain embodiments. Antenna 42 includes a planar reflector 44 and four V-shaped conductors $\mathbf{46}_{A1}$, $\mathbf{46}_{A2}$, $\mathbf{46}_{B1}$, $\mathbf{46}_{B2}$. V-shaped conductors $\mathbf{46}_{A1}$, $\mathbf{46}_{A2}$ form one dipole element $\mathbf{46}_{A}$ and V-shaped conductors $\mathbf{46}_{B1}$, $\mathbf{46}_{B2}$ form the other dipole element $\mathbf{46}_{B}$ of the antenna 42. Collectively, the two dipole elements may be referenced as $\mathbf{46}_{A}$ and $\mathbf{46}_{B}$, and collectively the V-shaped conductors may be referenced as 46. It should be noted that while in this example, each of the two dipole elements $\mathbf{46}_{A}$ and $\mathbf{46}_{B}$ is comprised of two V-shaped conductors ($\mathbf{46}_{A1}$, $\mathbf{46}_{A2}$; and $\mathbf{46}_{B1}$, $\mathbf{46}_{B2}$), in certain embodiments, each dipole element may be comprised of only one V-shaped conductor, or of more than two V-shaped conductors. Further, it may be convenient to consider the antenna 42 as comprising two dipoles, stacked one over the other. The first of these two dipoles according to this definition is constituted by V-shaped conductors $\mathbf{46}_{A1}$, $\mathbf{46}_{B1}$; and the second of these two dipoles according to this definition is constituted by V-shaped conductors $\mathbf{46}_{A2}$, $\mathbf{46}_{B2}$.

In the simplified view of FIG. 8, the reflector 44 is depicted as a planar conductive sheet. In certain embodiments, the dimensions of the reflector are about 17×21 inches. However, the size can be scaled for other frequency ranges and should not be taken as limiting. Further, the reflector 44 can be implemented as a UHF reflector in many different ways, including as a grid or lattice of wires (FIG. 9), punched sheet metal, a series of horizontal conductors, and so on. In certain embodiments, a signal-combining harness 48 can be used to lend structural support as well as to provide electrical connection as detailed below.

Figure 10:
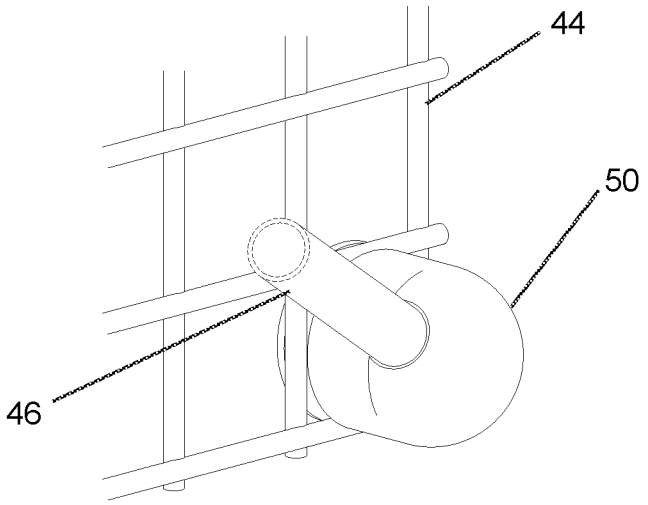
FIG. 10 shows a close detail of an insulator block in accordance with certain embodiments.

In certain embodiments, the four V-shaped conductors 46 are arranged substantially symmetrically about a center point of the antenna, protruding forward of the reflector 44 at approximately 45 degrees (FIG. 10(*a*)). Thus in certain embodiments each of the V-shaped conductors 46 lies in a plane that is transverse to the plane of the reflector 44, at the angle of about 45 degrees. In certain embodiments, the tip-to-tip spacing of the ends of each V-shaped conductor is about 7.5", giving a V-angle of about 48 degrees. The open ends of each V-shaped conductor 46 do not electrically connect to the reflector 44, but are spaced approximately 0.4" in front of the reflector surface and separated therefrom by appropriate insulating material (possibly air) as described below. The V-shaped conductors 46 are depicted as if fabricated out of the standard ⅜" TV antenna aluminum tubing, which would be the case when made commercially available. However, this should not be construed as limiting as other dimensions and materials are contemplated.

Signal-combining feed harness 48 is made of ⅛" aluminum in certain embodiments, and serves to connect the apex of each V-shaped conductor 46 to a signal output point, for example located in the center of the antenna, as described below. In particular, harness portion $\mathbf{48}_{A}$ is electrically coupled to the apex of V-shaped conductors $\mathbf{46}_{A1}$, $\mathbf{46}_{A2}$ of dipole element $\mathbf{46}_{A}$, and harness portion $\mathbf{48}_{B}$ is electrically coupled to V-shaped conductors $\mathbf{46}_{B1}$, $\mathbf{46}_{B2}$ of dipole element $\mathbf{46}_{B}$. Another function of the feed harness 48 is to act as an impedance matching transformer to assure that the overall output impedance of the antenna has the characteristics shown in FIGS. 6 and 7. In certain embodiments, feed harness 48 lends structural support to the V-shaped conductors, and the antenna in general, as well as the electrical connection and functionality.

In FIG. 9, a detailed drawing of an implementation of the wide-direction antenna 42 in accordance with certain embodiments is shown. In this implementation, the reflector 44 is composed of a wire metal grid of 1" squares, allowing other components of the antenna to be easily attached to the reflector, with the reflector forming the main structural component. At each corner and along the sides are located insulator blocks 50 which support the ends of the four V-shaped conductors $\mathbf{46}_{A1}$, $\mathbf{46}_{A2}$, $\mathbf{46}_{B1}$, $\mathbf{46}_{B2}$, affixing them to the reflector 44. In certain embodiments, the insulator blocks separate the tips of the V-shaped conductors from the reflector 4 by about 0.4 inches.

FIG. 10 shows a close detail of one of the blocks 50, where the end, or tip, of the V-shaped conductor 46 is inserted into a hole in the block for support. Such a method of support is simple and need not require any fasteners, thereby simplifying assembly of the antenna. The insulator block 50 is attached to the reflector 44 with a bolt, screw, snap-in feature, or the like, from the rear of the reflector (not shown). Other fastening means are also contemplated. Two insulating bars 52 provide support and maintain the spacing of the apex of each pair of V-shaped conductors 46. As shown in the detail of FIG. 11, these insulators are composed of simple non-conducting material, such as two-piece plastic or other standard antenna insulating material, held together by a centrally located fastener 54, such as a screw, rivet, snap feature, or the like. Other materials and fastening means are contemplated.

Figure 12:
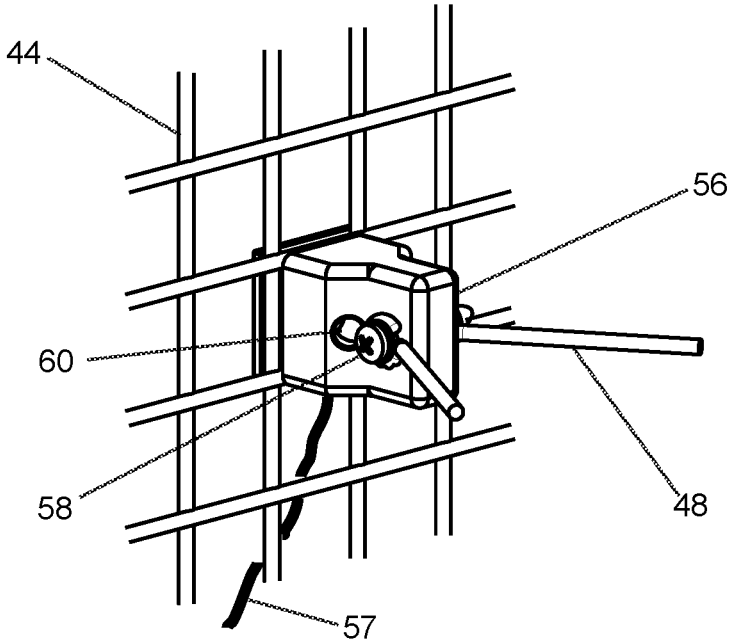
FIG. 12 shows a feed point insulator assembly which provides convenient attachment points for an electrical signal down lead cable in accordance with certain embodiments.

FIG. 12 shows a detail of the feed point insulator assembly 56 which provides convenient attachment points for an electrical signal down lead cable 57 in accordance with certain embodiments. Feed point insulator assembly 56 is disposed substantially in the center of reflector 44 and provides an anchoring point for mechanically securing the feed harness 48. In certain embodiments, feed point insulator assembly 56 is configured to accommodate any of several connection methods for electrically connecting the antenna 42 to the TV. For example, assuming that the antenna is to be fed with 300 Ohm twin-lead, in certain embodiments each conductor (not shown) of the down lead may be attached to each of the screws 58, and the down lead 57 simply allowed to drape down from this attachment point in front of the reflector 44. In certain embodiments, two holes 60 (only one is shown) may be provided in the feed point insulator assembly 56 to allow the down lead to be located behind the reflector 44 so that each twin lead conductor passes through the insulator assembly for attachment to the feed harness 48 by the screws 58 or other fasteners. Alternatively, a balun transformer (e.g. a 300 Ohm to 75 Ohm balun), not shown, can be connected in the same way as the 300 Ohm balanced down lead, thereby allowing for a standard 75 Ohm unbalanced, and shielded, TV down lead to be used. Further, the feed point insulator assembly 56 can be hollow, to form a housing, inside of which is located the balun transformer, with the 75 Ohm TV connector either exiting the rear of the housing, making the connector conveniently available behind the reflector, or exiting the bottom of the housing, whereby the connector readily allows for a 75 Ohm coaxial down lead to simply drape straight down in front of the reflector 44. Any of these arrangements will not affect the reception operation of the antenna 42, but can provide convenient alternatives for mounting and connecting the antenna.

Figure 13:
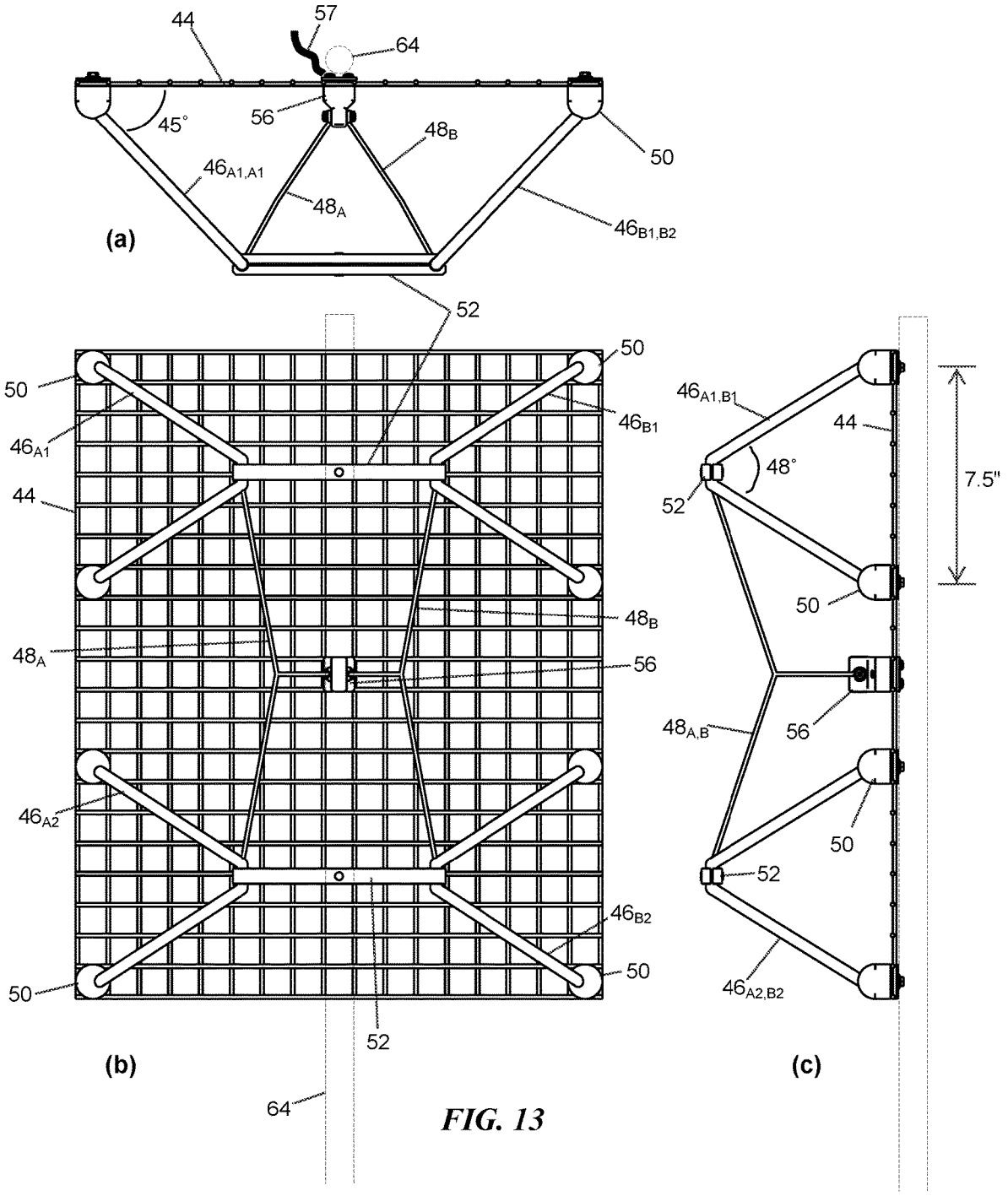
FIG. 13 shows the structure of an antenna in accordance with certain embodiments in three orthogonal views: top view FIG. 13(*a*), front view FIG. 13(*b*), and side view FIG. 13(*c*)

FIG. 13 shows the structure of antenna 42 in three orthogonal views: top view FIG. 13(*a*), front view FIG. 13(*b*), and side view FIG. 13(*c*). Here the means for attaching the active elements to the reflector become clear. The insulator blocks 50 for example can have molded snap-in features (not shown) for easy and inexpensive attachment and construction, although many alternative attachment methods are contemplated and should not be considered limiting in any way.

As seen from FIG. 14, the V-shaped conductors 46 are provided with a double-bend at their apex, forming a short, substantially straight segment 62 between the two bends. Although convenient for spacing and/or supporting the elements, this is not the only shape which is contemplated for V-shaped conductors 46. For example, the apex can be formed by a single smooth radius, or even a sharp corner in certain embodiments.

One consideration in designing an antenna is how it can be mounted, whether indoors or outdoors. Such consumer antennas are usually mounted to a vertical mast made of metallic tubing, which provides a convenient means for adjusting the height and azimuthal pointing angle. Such a mast 64 is shown in FIG. 13. Attachment means for connecting the antenna to the mast can take the form of any of numerous means well-known in the art, and is therefore not shown.

Figure 15:
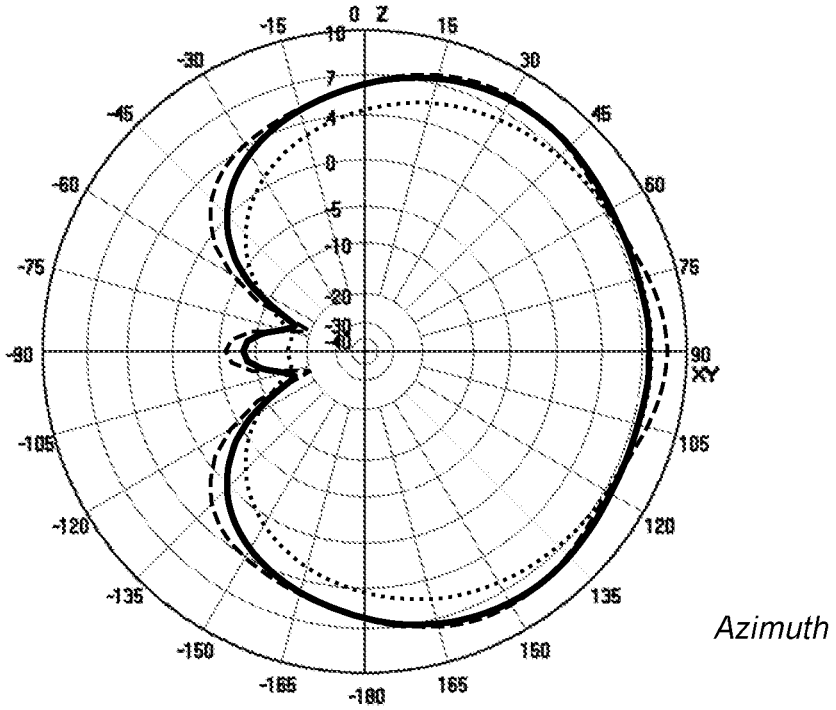
FIG. 15 shows directional reception performance in the horizontal, or azimuthal, plane of a wide-direction antenna in accordance with certain embodiments.

Directional reception performance in the horizontal, or azimuthal, plane of a wide-direction antenna such as antenna 42 is shown in FIG. 15 for the three frequencies of 470, 590 and 710 MHz. These represent the low edge of the HDTV UHF band, center of the band, and upper edge of the band, i.e. covering the entire range of broadcast frequencies for an HDTV application for the antenna 42. Remarkably, the directional performance is within a few dB over all angles and frequencies, i.e. is virtually uniform. This allows the antenna 42 to provide excellent and constant reception quality for all stations within the reception sector, while still highly attenuating any interfering signals coming from the rear of the antenna.

Figure 16:
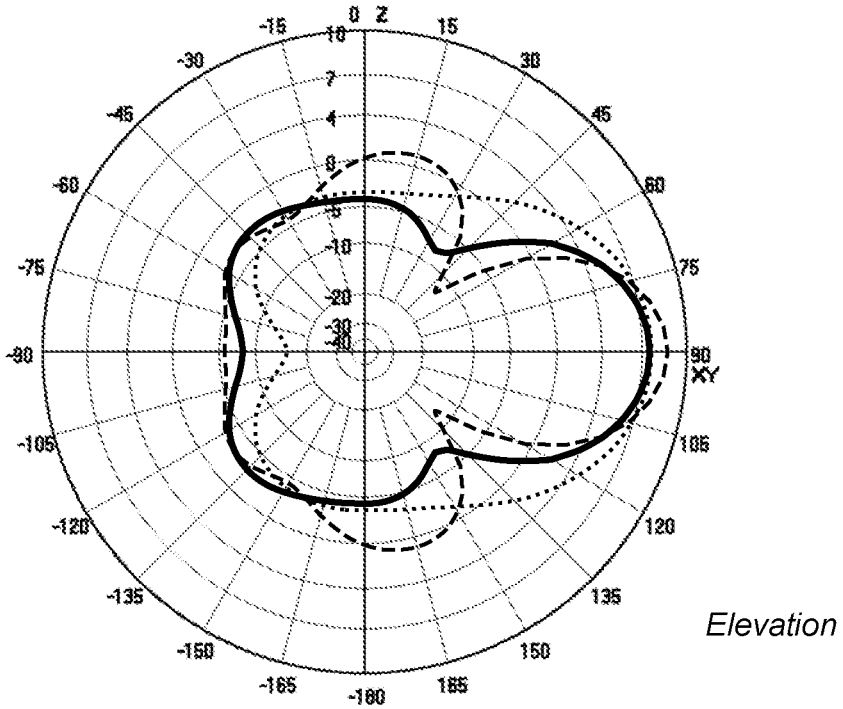
FIG. 16 shows exemplary directional reception performance of an antenna in accordance with certain embodiments in the vertical, or elevational, plane.

FIG. 16 shows the exemplary directional reception performance of antenna 42 in the vertical, or elevational, plane. It is desirable to have low sensitivity for signals arriving from above and below the antenna, as well as from behind. This minimizes interference from undesirable signal sources located above and/or below the antenna, such as reflections from, for example, overhead airplanes and/or basement electrical equipment, just to mention a couple of examples. As can be seen in FIG. 16, the exemplary antenna 42 demonstrates approximately less than 0 dBi gain from 145 degrees to 35 degrees elevation, that is, over a 250 degrees wide sector that eliminates interfering signals arriving from the rear and above and below. Further, this performance is maintained over the entire frequency range of the antenna. The result is that the performance shown in FIGS. 15 and 16 combines to produce a "pancake" shaped reception pattern with a piece of the "pancake" sliced off the rear of the cake.

Figure 17:
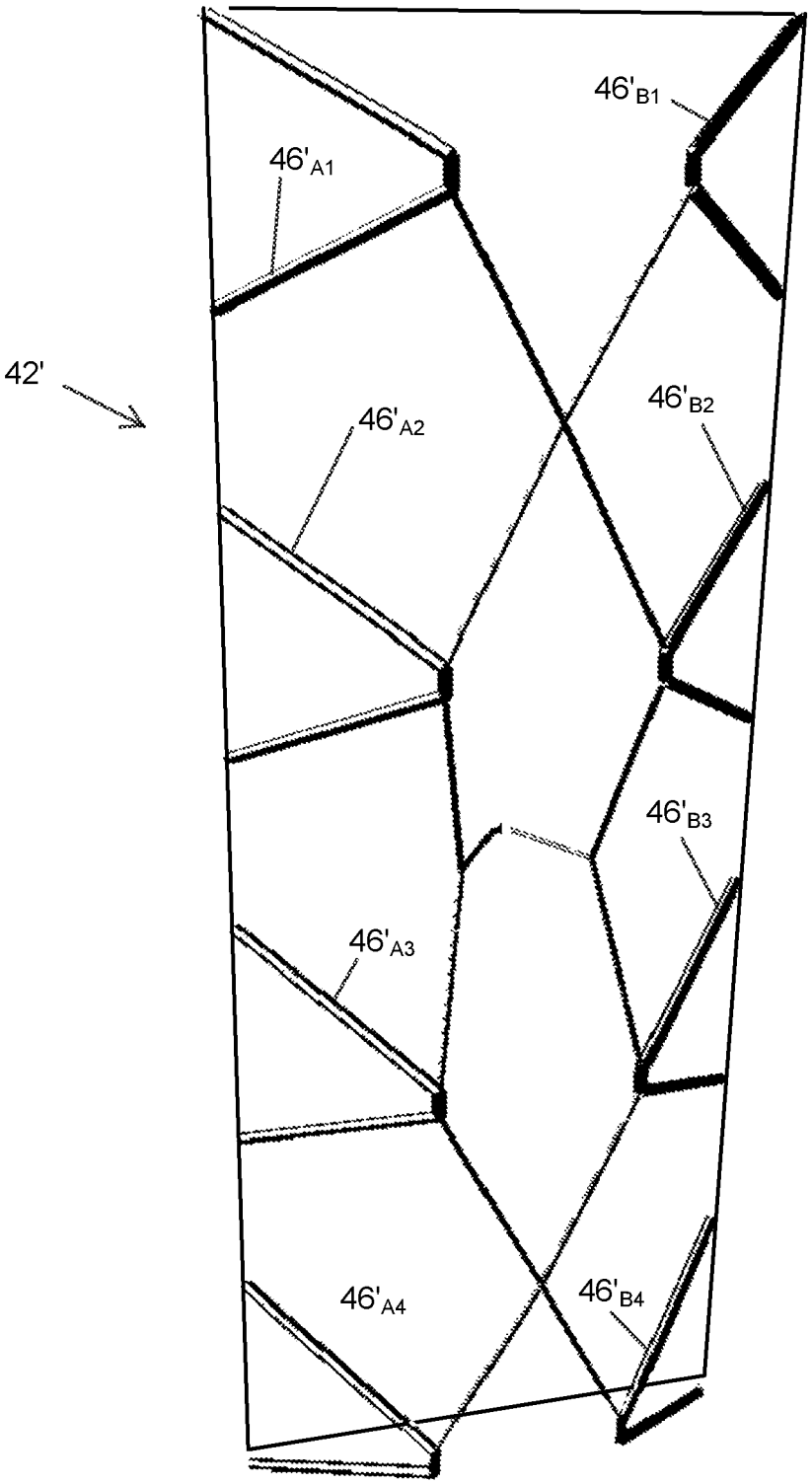
FIG. 17 shows an antenna with each of the two dipole elements having four vertically-stacked V-shaped conductors in accordance with certain embodiments.

The structure of antenna 42 is one of many possible configurations that meet the specifications described herein. As another example, FIG. 17 shows an extension on the concept, but with each of the two dipole elements $\mathbf{46'}_{A}$, $\mathbf{46'}_{B}$ of the antenna 42' having four vertically-stacked V-shaped conductors 46'. It may be convenient to consider the antenna 42' as comprising four dipoles (quadruple dipole), stacked one over the other. The first of these two dipoles according to this definition is constituted by V-shaped conductors $\mathbf{46'}_{A1}$, $\mathbf{46'}_{B1}$; the second of these four dipoles according to this definition is constituted by V-shaped conductors $\mathbf{46'}_{A2}$, $\mathbf{46'}_{B2}$; the third of these four dipoles according to this definition is constituted by V-shaped conductors $\mathbf{46'}_{A3}$, $\mathbf{46'}_{B3}$; and the fourth of these four dipoles according to this definition is constituted by V-shaped conductors $\mathbf{46'}_{A4}$, $\mathbf{46'}_{B4}$.

Compared to the exemplary double-dipole antenna shown in FIG. 8, this quadruple dipole antenna exhibits greater gain as a result of further reducing the elevational beam width while preserving the rest of the antenna's fundamental desirable properties as discussed above. Although this is achieved at the expense of doubling the height of the antenna, this increase in size is not an issue when the antenna is mounted in an outdoor location.

The antennas described herein are scalable in frequency. However, when scaling the antennas, the resulting reception patterns may alter. Further tuning and adjustments of the antenna segments after scaling can be used to achieve the same, or nearly identical, performance, without departure from the spirit or scope of the invention.

While embodiments and applications have been shown and described, it would be apparent to those skilled in the art having the benefit of this disclosure that many more modifications than mentioned above are possible without departing from the inventive concepts disclosed herein. The invention, therefore, is not to be restricted based on the foregoing description. This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

What is claimed is:

1. An antenna for receiving incident electromagnetic (EM) radiation, the antenna comprising: a dipole having first and second elements; a feed harness; and a reflector for reflecting the incident EM radiation into reflected EM radiation, wherein the reflector, said first element, and said second element are configured to orient the first element substantially broadside to the reflected EM radiation and end-fire to the incident EM radiation when the second element is oriented substantially broadside to the incident EM radiation, wherein each element comprises four V-shaped conductors, the feed harness connecting the apex of each V-shaped conductor to a signal output point.

2. An antenna for receiving incident electromagnetic (EM) radiation, the antenna comprising: a dipole having first and second elements; a feed harness; and a reflector for reflecting the incident EM radiation into reflected EM radiation, wherein: the reflector, said first element, and said second element are configured to orient the first element substantially broadside to the reflected EM radiation and end-fire to the incident EM radiation when the second element is oriented substantially broadside to the incident EM radiation the reflector is planar and each dipole element comprises one or more V-shaped conductors lying in a plane that is transverse to the plane of the reflector, and the V angle of each V-shaped conductor is about 48 degrees; and the feed harness connecting the apex of each V-shaped conductor to a signal output point.

3. The antenna of claim 2, wherein the transverse plane is transverse at an angle of about 45 degrees.

4. The antenna of claim 2, further a pair of insulator blocks associated with each V-shaped conductor, each insulator of the pair affixing the associated V-shaped conductor to the reflector.

5. The antenna of claim 4, wherein each insulator separates a tip of the associated V-shaped conductor from the reflector by a distance about 0.4 inches.

6. The antenna of claim 4, wherein tips of each V-shaped conductor are about 7.5 inches apart.

7. The antenna of claim 2, wherein the reflector is about 17 inches wide and about 21 inches long.

8. The antenna of claim 7, wherein the reflector is a wire metal grid of one-inch squares.

9. An antenna for receiving incident electromagnetic (EM) radiation, the antenna comprising: a dipole having first and second elements; a reflector for reflecting the incident EM radiation into reflected EM radiation, wherein: the reflector, said first element, and said second element are configured to orient the first element substantially broadside to the reflected EM radiation and end-fire to the incident EM radiation when the second element is oriented substantially broadside to the incident EM radiation, and each said element comprises two V-shaped conductors; and a feed harness having a first portion electrically coupled to the apex of the two V-shaped conductors of the first element, and a second portion electrically coupled to the apex of the two V-shaped conductors of the second element.

10. The antenna of claim 9, further comprising an insulator assembly attaching the first and second portions of the feed harness to the reflector.

11. The antenna of claim 10, wherein the insulator assembly electrically couples the feed harness to a down lead cable.

12. The antenna of claim 11, wherein the insulator assembly is disposed substantially in the center of the reflector.

* * * * *